US009015881B2

(12) United States Patent
Kress

(10) Patent No.: US 9,015,881 B2
(45) Date of Patent: Apr. 28, 2015

(54) EXERCISE MAT

(71) Applicant: Margaret Kress, Los Angeles, CA (US)

(72) Inventor: Margaret Kress, Los Angeles, CA (US)

( * ) Notice: Subject to any disclaimer, the term of this patent is extended or adjusted under 35 U.S.C. 154(b) by 0 days.

(21) Appl. No.: 13/852,944

(22) Filed: Mar. 28, 2013

(65) Prior Publication Data

US 2013/0276230 A1 Oct. 24, 2013

Related U.S. Application Data

(63) Continuation-in-part of application No. 13/379,488, filed as application No. PCT/US2010/040544 on Jun. 30, 2010, now abandoned.

(60) Provisional application No. 61/801,060, filed on Mar. 15, 2013.

(51) Int. Cl.

| | |
|---|---|
| ***A47G 9/06*** | (2006.01) |
| ***A63B 21/00*** | (2006.01) |
| *A63B 71/06* | (2006.01) |

(52) U.S. Cl.

CPC ..... *A47G 9/062* (2013.01); *A63B 21/1473* (2013.01); *A63B 2071/0694* (2013.01)

(58) Field of Classification Search

CPC ..... A47G 9/062; A63B 21/1473; A63B 2071/0694

USPC ..... 5/417

See application file for complete search history.

(56) References Cited

U.S. PATENT DOCUMENTS

| | | | | |
|---|---|---|---|---|
| 1,930,942 | A | | 10/1933 | Pringles et al. |
| 2,264,471 | A | | 12/1941 | Glenn et al. |
| 3,262,134 | A | | 7/1966 | Bramble, Jr. |
| 3,774,249 | A | | 11/1973 | Ybarra et al. |
| 4,137,583 | A | | 2/1979 | Baldwin et al. |
| 4,601,076 | A | | 7/1986 | Knobeloch et al. |
| 4,609,580 | A | * | 9/1986 | Rockett et al. ..... 428/198 |
| 4,644,592 | A | * | 2/1987 | Small ..... 4/583 |
| 4,738,545 | A | | 4/1988 | Westgor et al. |
| 4,841,587 | A | | 6/1989 | Cutter et al. |
| 5,018,230 | A | | 5/1991 | Steberger et al. |
| 5,099,530 | A | | 3/1992 | Scott et al. |
| 5,199,120 | A | | 4/1993 | Holmes et al. |
| 5,203,041 | A | | 4/1993 | Alonso et al. |

(Continued)

FOREIGN PATENT DOCUMENTS

| | | |
|---|---|---|
| CH | 568767 | 11/1975 |
| DE | 3440771 | 5/1986 |

(Continued)

OTHER PUBLICATIONS http://yogitoes.com/shop-skidless.

*Primary Examiner* — Peter M Cuomo
*Assistant Examiner* — Brittany Wilson
(74) *Attorney, Agent, or Firm* — Lerner, David, Littenberg, Krumholz & Mentlik, LLP

(57) ABSTRACT

An inventive mats system is provided in which a towel can be removed and changed when desired. The mat system can manipulated into a rolled configuration. When rolled, a logo on the bottom of the base mat is visible. At least one elastic strap is used to keep the mat in the rolled configuration for easy toting and storage. The system includes a holding mechanism that allows the towel to be secured to the mat mechanically. The towel has a skidless surface on top to allow a user not to slid off the towel.

18 Claims, 16 Drawing Sheets

(56) References Cited

U.S. PATENT DOCUMENTS

| | | | | |
|---|---|---|---|---|
| D336,199 | S * | 6/1993 | Bazata, Jr. | D6/596 |
| 5,500,267 | A * | 3/1996 | Canning | 428/68 |
| 5,720,057 | A | 2/1998 | Duncan et al. | |
| 5,733,629 | A * | 3/1998 | Insley | 428/141 |
| 6,065,164 | A | 5/2000 | Swanger et al. | |
| 6,141,805 | A | 11/2000 | Fisher-Cohen et al. | |
| 6,751,816 | B1 | 6/2004 | Wechsler et al. | |
| 6,920,655 | B2 | 7/2005 | Mitchell et al. | |
| 7,485,071 | B2 * | 2/2009 | Edwards | 482/23 |
| 7,657,952 | B2 | 2/2010 | Hutchison | |
| 7,850,498 | B2 * | 12/2010 | Yeh | 441/65 |
| 8,220,087 | B2 * | 7/2012 | Villa et al. | 5/420 |
| 2002/0088053 | A1 * | 7/2002 | Swagger, Jr. | 5/420 |
| 2004/0088789 | A1 * | 5/2004 | Mitchell | 5/420 |
| 2004/0250346 | A1 * | 12/2004 | Vasishth | 5/417 |
| 2005/0192158 | A1 * | 9/2005 | Edwards | 482/23 |
| 2006/0225181 | A1 * | 10/2006 | Rou | 2/46 |
| 2007/0071961 | A1 | 3/2007 | Kao | |
| 2008/0152860 | A1 * | 6/2008 | Meyer | 428/100 |
| 2008/0222851 | A1 * | 9/2008 | Rou | 24/9 |
| 2009/0297811 | A1 * | 12/2009 | Hutchinson | 428/220 |
| 2013/0125307 | A1 * | 5/2013 | Margalit | 5/417 |
| 2013/0153081 | A1 * | 6/2013 | Garbarino | 139/420 R |

FOREIGN PATENT DOCUMENTS

| | | | | |
|---|---|---|---|---|
| FR | 2831415 | A1 * | 5/2003 | A47K 10/02 |
| GB | 2388052 | | 11/2003 | |

* cited by examiner

EXERCISE MAT

FIELD OF THE INVENTION

The invention relates to an exercise mat assembly adapted for Yoga and other exercise disciplines.

BACKGROUND

Any activity that takes place on the ground or on the floor is made easier and more pleasant with the use of a mat or other padded surface. Early patents for such mats were designed for sleeping outdoors or for use at the beach. Later various sports required surfaces with different degrees of softness and a variety of athletic mats were developed. Yoga, having been practiced for many years by a limited following, has only recently reached a broader segment of the population and has created a market for mats suited to the special requirements of this practice.

In U.S. Pat. No. 6,751,816, Wechsler provides a mat with an absorbent cover which can be removed and replaced during the exercise session. The patent provides an enforced area for headstands and other positions, as well as a meditation blanket, and roll-up capabilities that create a self-contained carry bag.

In U.S. Pat. No. 1,930,942, Pringle discloses a foldable combination of sheet and bag for use on the ground or on a deck chair. The sheet has side flaps that can be folded over the user for warmth. There is a cushion at one end of the sheet and a bag at the other. The sheet and cushion can be rolled or folded into the bag for carrying. A back rest can be used with the sheet and can be collapsed to fit into the bag which may also have a carrying strap attached.

Another beach blanket assembly is taught by Glenn in U.S. Pat. No. 2,264,471. This one has a canvas bottom layer and a top layer of toweling. One end of the canvas is folded over and stitched to form one or more pockets which may be closed with zippers.

A foldable mat having a pad enclosed in fabric and a top cover layer, for use by a small child in a nursery school, is disclosed by Ybarra et al. in U.S. Pat. No. 3,774,249. A similar sleeping apparatus for use by adults is taught by Knobeloch in U.S. Pat. No. 4,601,076. This mat has a cover sheet that can be stored in a pocket at the foot end, and the mat can be rolled and tied for storage. See also U.S. Pat. No. 5,199,120 to Holmes; U.S. Pat. No. 5,720,057 to Duncan; and U.S. Pat. No. 6,141,805 to Fisher-Cohen et al. Carter et al. describes a padded mat with a pillow area and a built-in sound system to provide a relaxing experience (U.S. Pat. No. 4,841,587).

All of these products have padding between layers of fabric and in some systems a separate cover layer. They also have a separate carrying bag or the mat can be folded or rolled into an attached bag.

Swanger et al., in U.S. Pat. No. 6,065,164, teaches a fabric cover for a child's play mat. The cover is made of a washable fabric that is at least part cotton. The cover is in the form of an envelope with a Velcro™ fastener at one end. A child's rest mat that consists of a foam pad enclosed in a removable fabric cover is disclosed by Alonso in U.S. Pat. No. 5,203,041. The cover is stitched around three sides and there is an extra flap of fabric at the open end which is folded over the pad to completely enclose it. Three sets of lines are stitched into the fabric to form fold lines so the mat can be folded in a uniform manner. Two handles on the underside provide easy carrying means.

Scott discloses a similar washable cover for an exercise mat. (U.S. Pat. No. 5,099,530) The cover has one pocket for the insertion of a pillow and another pocket for a blanket.

A large mat for use by gymnasts and wrestlers is taught by Baldwin et al. in U.S. Pat. No. 4,137,583. A frame is made up of a number of segments so the size of the mat may be changed as needed. Cushioning pad segments are placed within the frame and a cover with elastic tie down devices all around is placed on top. The tie downs fit into notches in the frame to hold the cover taut. This mat system can be made large enough to cover most of a gym floor.

Bramble, Jr. (U.S. Pat. No. 3,262,134) designed a mat for use by athletes such as high jumpers. A cover contains two thick foam cushions, each encased within a shield and forming a square mat. The shields have openings so that air can be let in and out to retain the resiliency of the foam.

There are latex strips on the underside to prevent slippage on the floor.

A simple exercise mat made up of two sheets of fabric quilted together with a foam pad between them is disclosed by Westgor in U.S. Pat. No. 4,738,585. This mat has a double stitched channel around the entire periphery with a drawstring within the channel. When the exerciser is finished the gym clothes and shoes can be placed in the center of the mat and the drawstrings pulled causing the mat to be drawn into a carrying bag.

The prior art disclosed covers for mats that formed envelopes into which the mats had to be inserted. The insertion cannot be accomplished quickly and reversibly during the course of an exercise period. Other systems described secured mat covers which also cannot be quickly and easily removed and replaced.

Various mats for use by Yoga participants are available from matsmatsmats.com on the internet. This source reveals the standard vinyl sponge foam mat in several colors, kits with several components, and a tote bag as well as handled tote bags to contain the mats. Each item can be purchased separately. Yoga mats and tote bags are also available from other Internet sources. Mats, yoga blocks, stretching straps and canvas tote bags may be purchased from many sporting goods shops. Some sets consisting of a tote bag and mat are also available.

None of the prior art mats provide a system in which a towel can be added and removed as desired and where the matt system can be rolled for toting and storage.

SUMMARY OF THE INVENTION

An inventive mats system is provided in which a towel can be removed and changed when desired. A change of towel would be implemented, for example, due to sufficient use of the towel or if a different towel is desired for placement in the mat system. A different towel would be used, for example, if a different logo was desired. Alternatively, a different towel would be used if a different colored towel was desired by the user. The system includes a unique holding mechanism that allows the towel to be secured to the mat mechanically. The towel has a skidless surface on top to allow a user not to slid off the towel.

Furthermore, the mat system can manipulated into a rolled configuration. When rolled, a logo on the bottom of the base mat is visible. Elastic straps are used to keep the mat in the rolled configuration for easy toting and storage.

BRIEF DESCRIPTION OF THE DRAWINGS

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

DETAILED DESCRIPTION

Figure 1D:
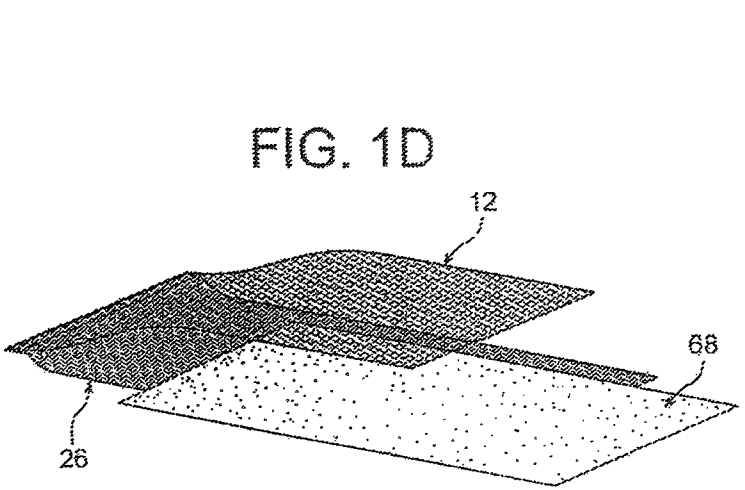
FIG. 1D illustrates the inventive yoga mat system, including top and base mats.
Figure 1B:
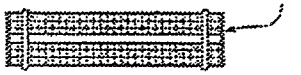
FIG. 1B illustrates the inventive yoga mat system, including top and base mats.
Figure 1C:
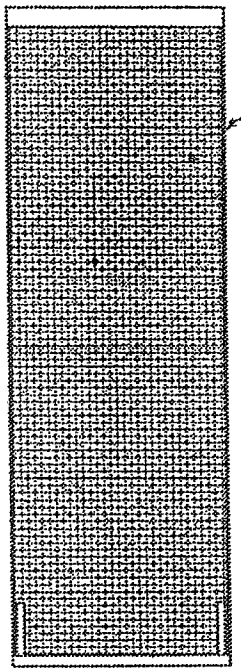
FIG. 1C illustrates the inventive yoga mat system, including top and base mats.
Figure 1A:
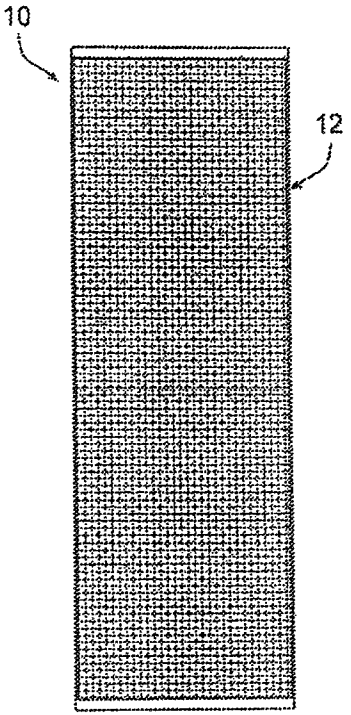
FIG. 1A illustrates the inventive yoga mat system, including top and base mats.
Figure 2A:
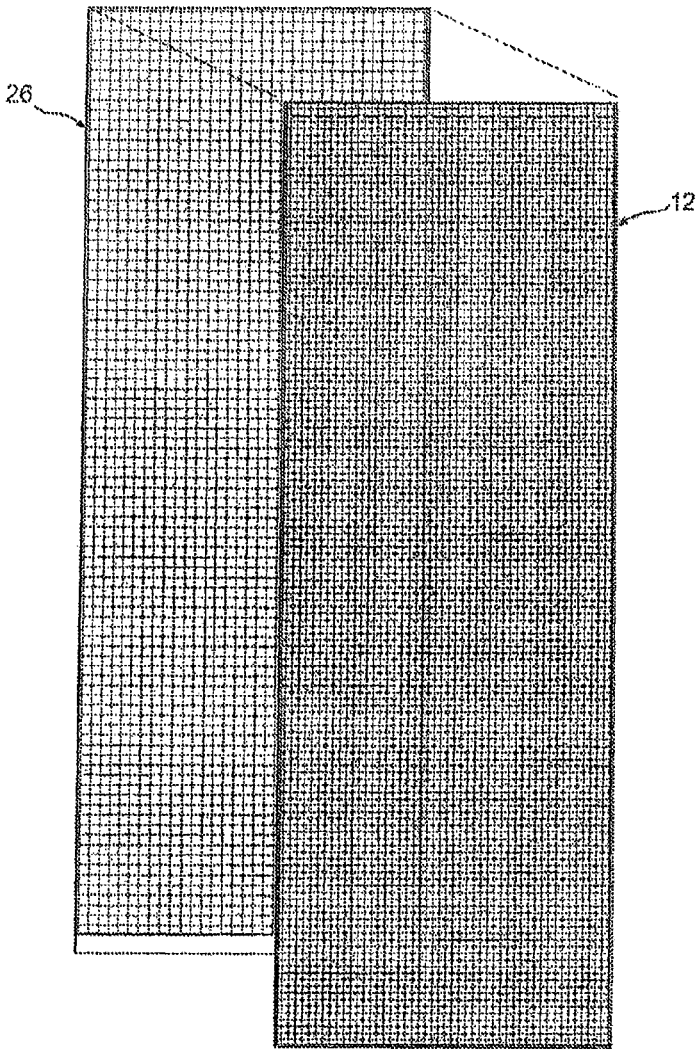
FIG. 2A illustrates permanent connections for the top and base mats.
Figure 2B:
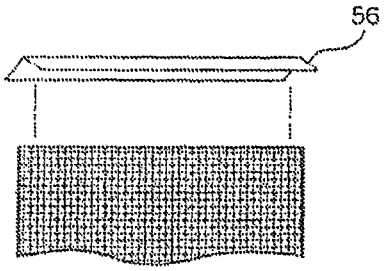
FIG. 2B illustrates permanent connections for the top and base mats.
Figure 2E:
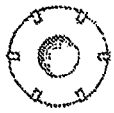
FIG. 2E illustrates permanent connections for the top and base mats.
Figure 2C:
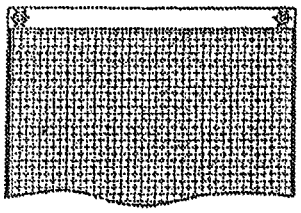
FIG. 2C illustrates permanent connections for the top and base mats.
Figure 2F:
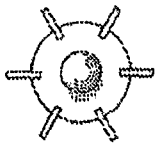
FIG. 2F illustrates permanent connections for the top and base mats.
Figure 2D:
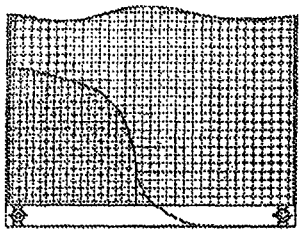
FIG. 2D illustrates permanent connections for the top and base mats.
Figure 2G:
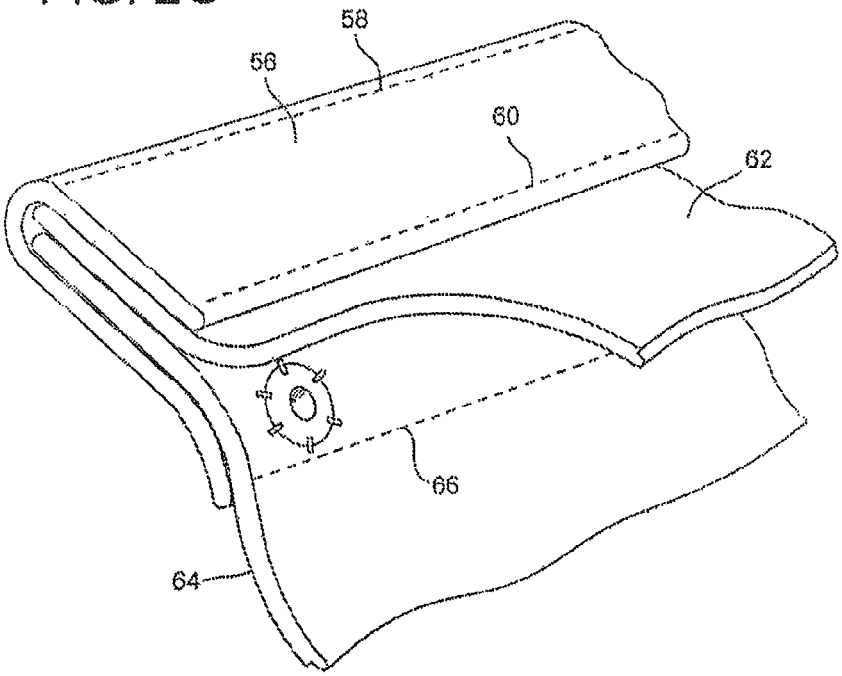
FIG. 2G illustrates permanent connections for the top and base mats.
Figure 2H:
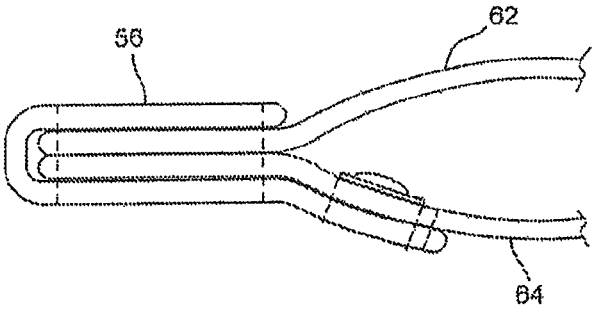
Figure 3A:
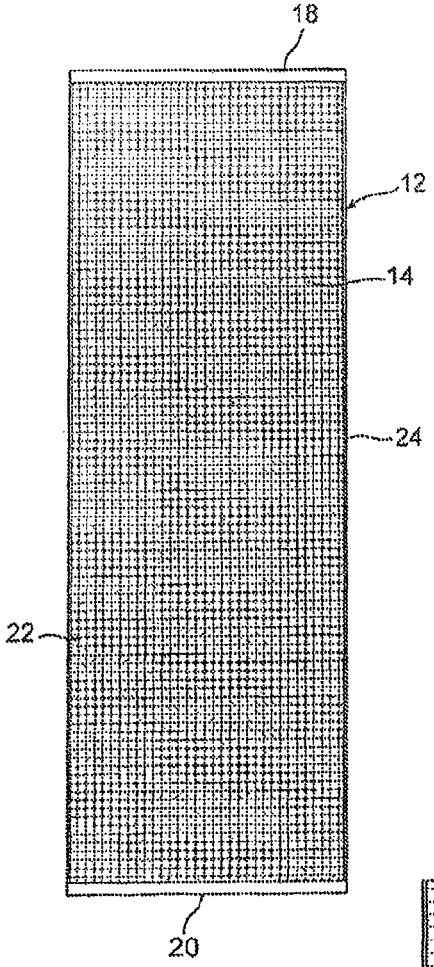
FIG. 3A further illustrates the top and base mats.
Figure 3B:
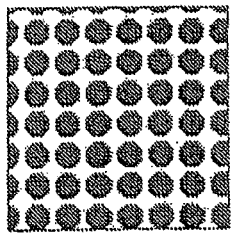
FIG. 3B further illustrates the top and base mats.
Figure 3C:
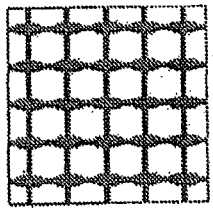
FIG. 3C further illustrates the top and base mats.
Figure 3D:
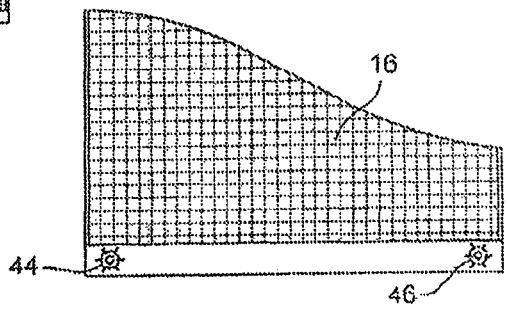
FIG. 3D further illustrates the top and base mats.
Figure 3E:
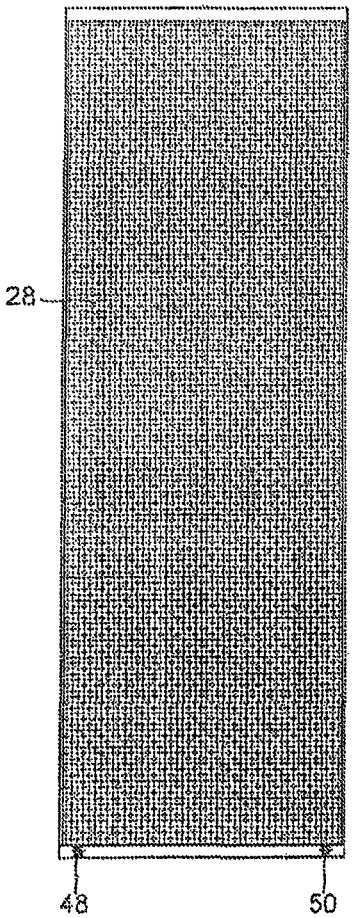
FIG. 3E further illustrates the top and base mats.
Figure 3F:
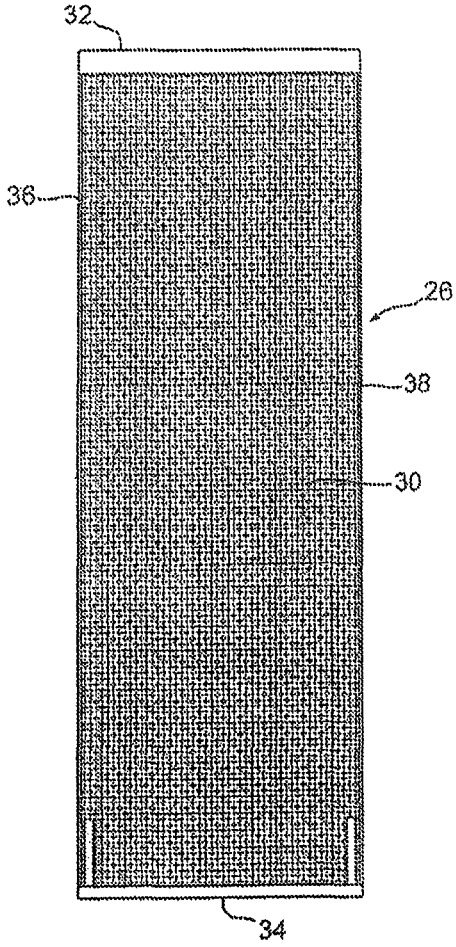
FIG. 3F further illustrates the top and base mats.
Figure 3G:
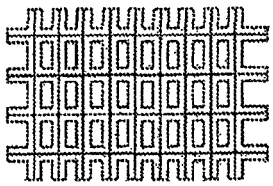
FIG. 3G further illustrates the top and base mats.

The invention provides for an attachable and removable towel sandwiched between a flexible base and a mesh. After the user attaches the towel to the flexible base and mesh, the mat assembly can be used for exercise, such as but not limited to yoga exercise. Perspiration from the user during exercise flows through the mesh and is absorbed by the towel. The towel is removable and may be washed after the exercise in a normal fashion. No solvents, sprays or wipes are necessary as needed in prior exercise mats. Straps on the mat assembly allow the mat assembly to be fixed in a roll for ease of transportation and storage.

Turning to FIGS. 1 and 3, a yoga mat system 10 is disclosed which has a top mat 12. As illustrated in FIG. 3, the top mat 12 has a top surface 14 and a bottom surface 16. When assembled, the top surface 14 faces outwardly from and the bottom surface faces inwardly towards the yoga mat. Viewed from the top surface 14, the top mat 12 has a top edge 18, a bottom edge 20, a left side edge 22 and a right side edge 24.

The mat system 10 also has a base mat 26. The base mat 26 has a top surface 28 and a bottom surface 30. When assembled, the bottom surface 30 faces outwardly and the top surface faces inwardly from the yoga mat. Viewed from the bottom surface (i.e., a mirrored view of the top surface of the top mat), the base mat 26 has a top edge 32, a bottom edge 34, a left side edge 36 and a right side edge 38.

An area defined by the mat system 10 is rectangular, with opposing edges extending in parallel to each other, with side edges of the top and base mats being substantially longer than the top and bottom edges. As illustrated in FIG. 3, the top and bottom edges of the top and base mats are two feet long and the sides edges are six feet long.

The material from which the top and base mats are manufactured is PVC molded over a thread mesh (see FIG. 3). The thickness of the mesh material for the top mat is 0.1 inches. The widthwise spacing between mesh strands in the top mat is 8.6 mm while the lengthwise spacing is 6.9 mm. The thickness of the mesh material for the bottom mat is 0.1875 inches. For reasons discussed below, the material enables rolling of the matt in one direction.

The widthwise spacing between mesh strands in the base mat is 4.2 mm, which is tighter than the spacing in the top mat. The lengthwise spacing in the base mat is 6.9 mm, the same as that in the top mat.

Figure 4A:
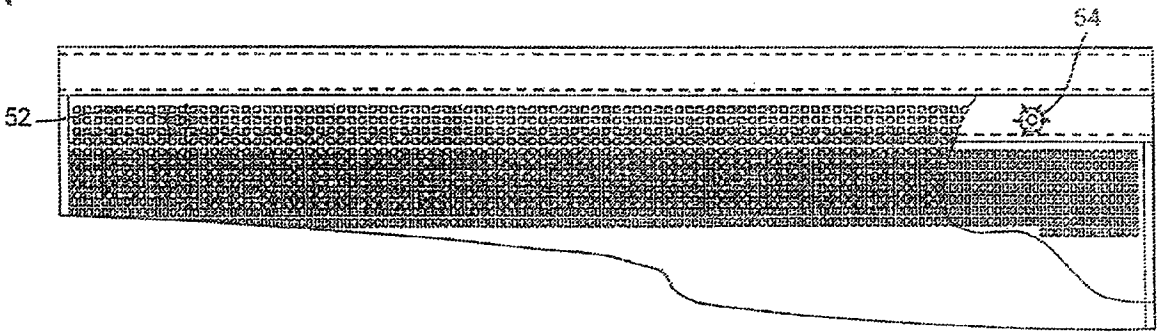
FIG. 4A illustrates portions of the top and base mats.
Figure 4B:
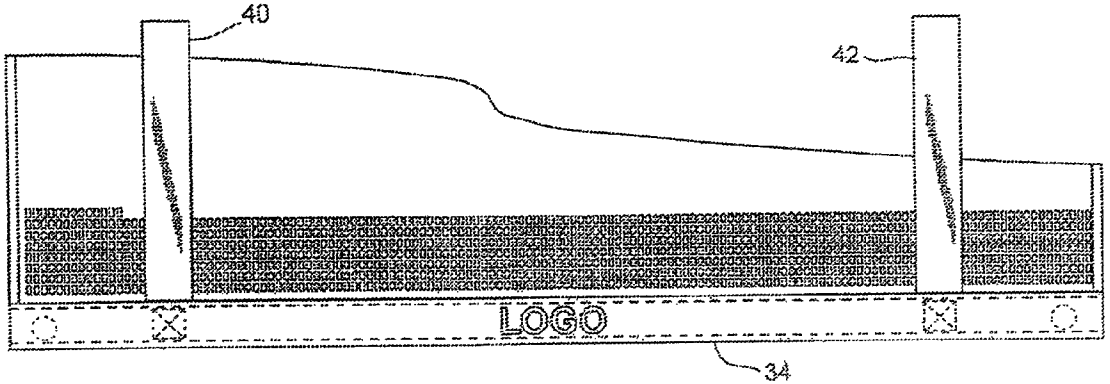
FIG. 4B illustrates portions of the top and base mats.
Figure 5A:
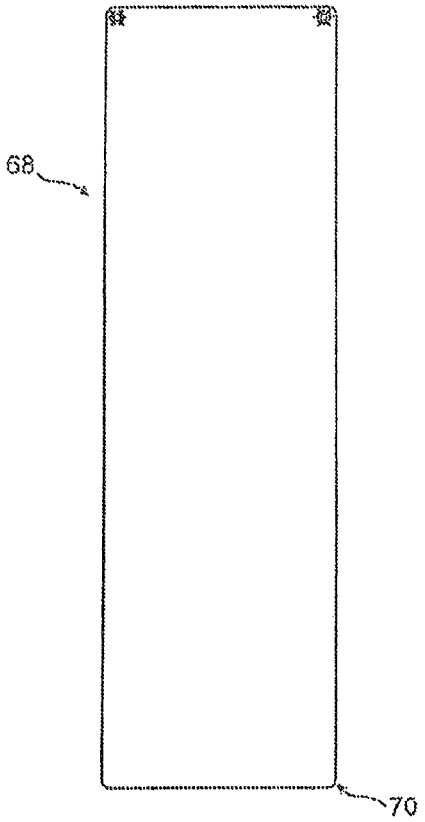
FIG. 5A illustrates a towel included in the inventive yoga mat system.
Figure 5B:
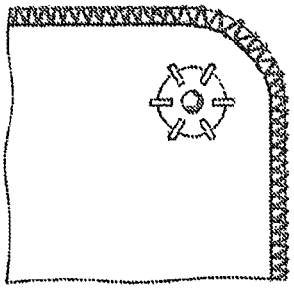
FIG. 5B illustrates a towel included in the inventive yoga mat system.
Figure 5C:
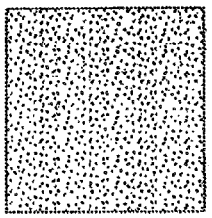
FIG. 5C illustrates a towel included in the inventive yoga mat system.
Figure 5D:
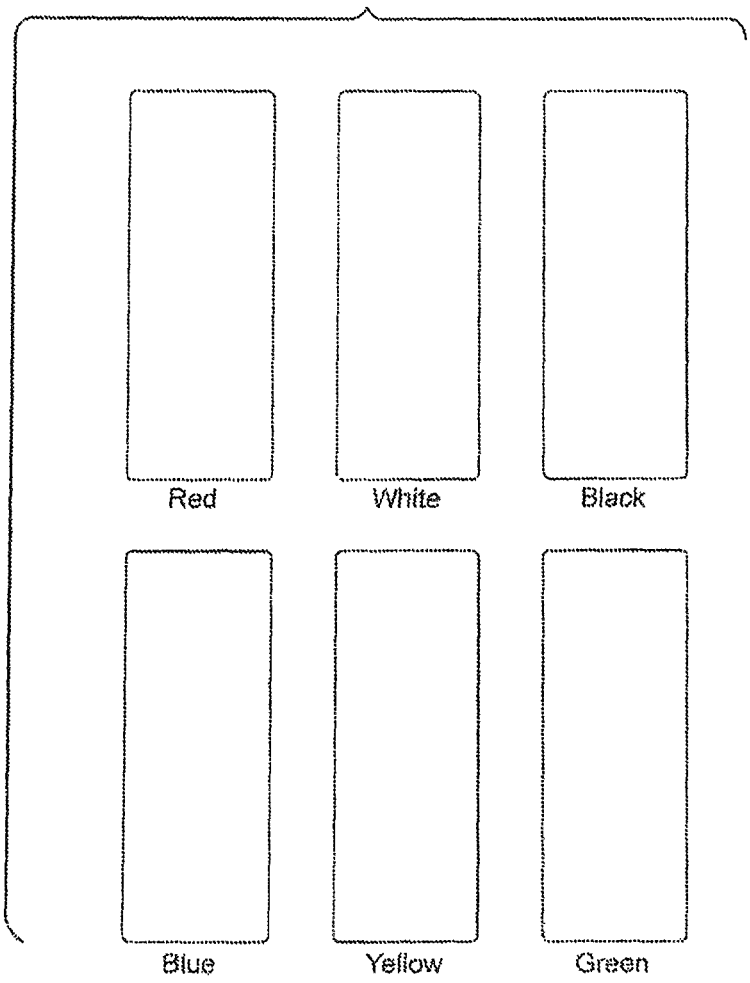
FIG. 5D illustrates a towel included in the inventive yoga mat system.

Both the top mat and the base mat have a [¼] inch edging on the two side edges. The same edging is located on the bottom edge 20 of the top mat. As seen in FIG. 4, the bottom edge 34 of the base mat has a one inch edging, adapted for being embroidered with a logo or other printing.

As illustrated in FIG. 4, a pair of elastic loops 40, 42 are located at the bottom edge of the bottom surface of the base mat. The loops 40, 42 are approximately six inches long and are capable of holding the mat when the mat is in a rolled-up configuration. The loops are positioned within the bottom edging of the base mat and are three inches from the side edges of the base mat.

Turning back to FIG. 3, a pair of ball snap sections 44, 46 are positioned at opposing corners of the bottom edge 20 of the bottom surface 16 of the top mat 12. On the other hand, snap socket sections 48, 50 are positioned at opposing corners of the bottom edge of the top surface of the bottom mat. The socket sections are positioned within the bottom edging of the base mat. These snap components are positioned [¾] of an inch from the side edges of the mat. For reasons discussed below, this positioning enables the top mat and base mat to form an openable connection at the bottom edge of the mat.

As illustrated in FIGS. 2 and 4, a further pair of snaps 56, 58 are positioned at opposing top corners of the top surface of the bottom mat. These snap components are spaced at 18.8 inches on center, and are therefore closer together than the snap components on the bottom edges of the mat surfaces. These snap components are positioned between one and two inches from the top edge of the mat.

Turning to FIG. 2, a connection for the top portions of the top mat and base mat are illustrated. A fabric edge piece 56 is positioned over adjoining top edges of the top and base mats. In this configuration, the bottom face of the top mat and the top face of the bottom mat face each other.

The fabric 56 is welded and stitched in place. Two rows of stitching 58, 60 are provided through both mats for strength. The two stitching rows 58, 60 are offset, lengthwise across the mat, such that the second stitching row secures a top free edge 62 of the fabric to the top surface of the top mat. The top free edge 60 of the fabric 56 does not extend below the snap components adjacent to the upper edge of the mat.

A second free edge 64 of the fabric edge 56 extends further along the base mat 26 than the top free edge 62 of the fabric 56 extends along the top mat 12. A third row of stitches 66 anchors the second free edge 64 of the fabric 56 to the bottom surface of the base mat 26. When secured, the second free edge 64 of the fabric 56 extends below the snap components adjacent to the upper edge of the mat so as to form a reinforcement section beneath the snap components.

The mat system includes a towel 68, illustrated in FIG. 5. The towel has the overall shape of the top and base mats in that it is rectangular. However, at twenty inches wide and sixty nine inches long, the towel is smaller than the mat so as to be removably placed between the top and base mats.

The towel 68 is fabricated from lightweight, non-stretchable bamboo. All edges of the towel are finished with an overlock stitch, such as a 3/16th overlock stitch. All corners edges, such as corner edge 70, are rounded.

Figure 6A:
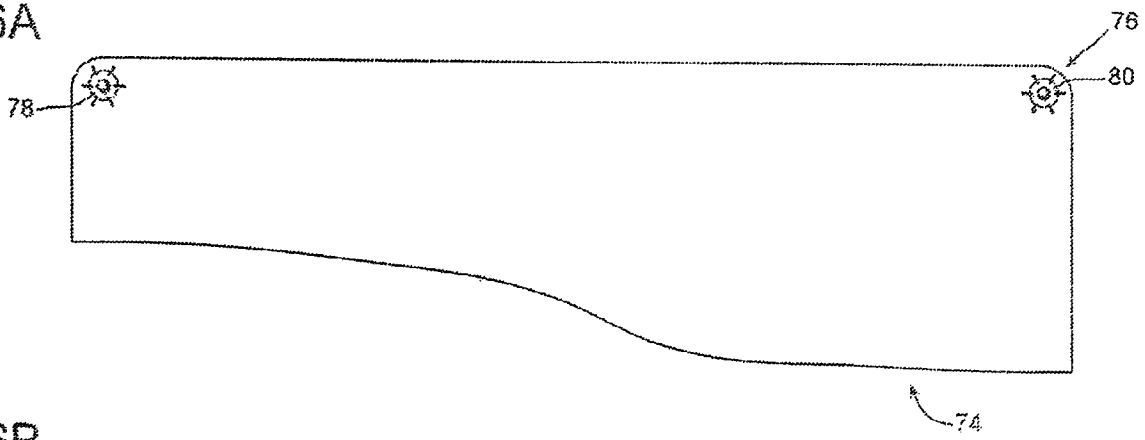
FIG. 6A illustrates portions of the towel.
Figure 6B:
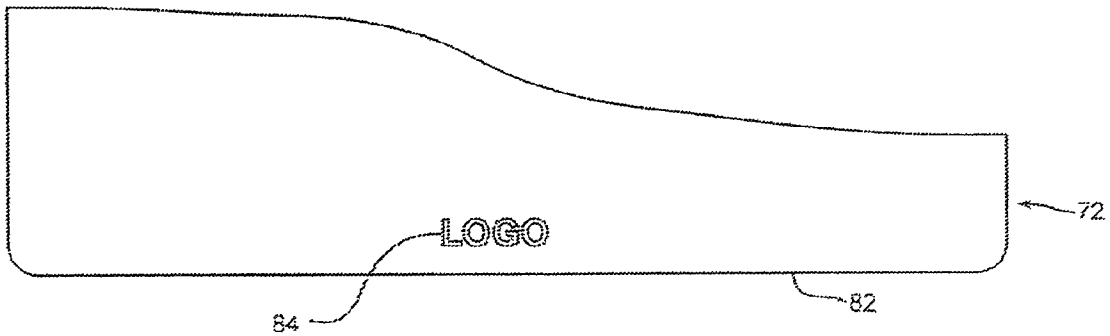
FIG. 6B illustrates portions of the towel.

As illustrated in FIG. 6, the towel has a top surface 72 and a bottom surface 74. Disposed at the top edge 76 of the bottom surface 74 are a pair of ball snaps 78, 80. As with the snap components in the top of the base mat, the ball snaps 78, 80 in the towel are 18.8 inches on center.

Adjacent to the bottom edge 82 in the top surface of towel is an area 84 designated for receiving graphical detail. The graphical detail is, for example, a printed or embroidered logo.

Turning back to FIG. 1, the typical use of the mat system is illustrated. The top and base mats 12, 26, connected at the respective top edges, are capable of receiving the towel therebetween. The snap balls in the towel are connected to the snap sockets in the top of the base mat.

The bottom snaps between the base mat and top mat are then connected and a single mat system is formed.

Figure 7A:
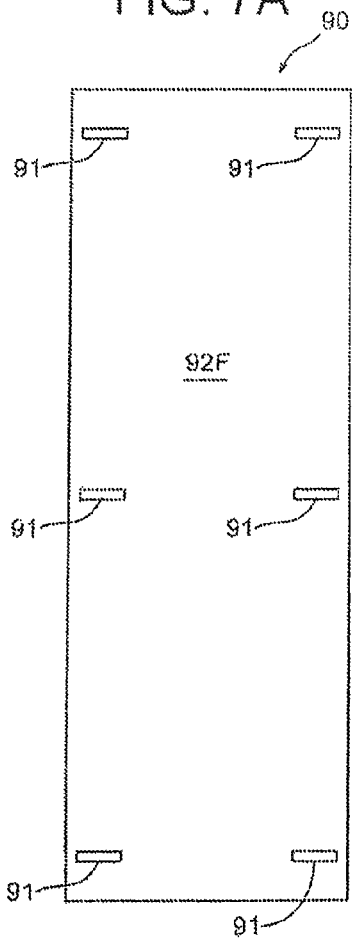
FIG. 7A illustrates other fasteners.
Figure 7B:
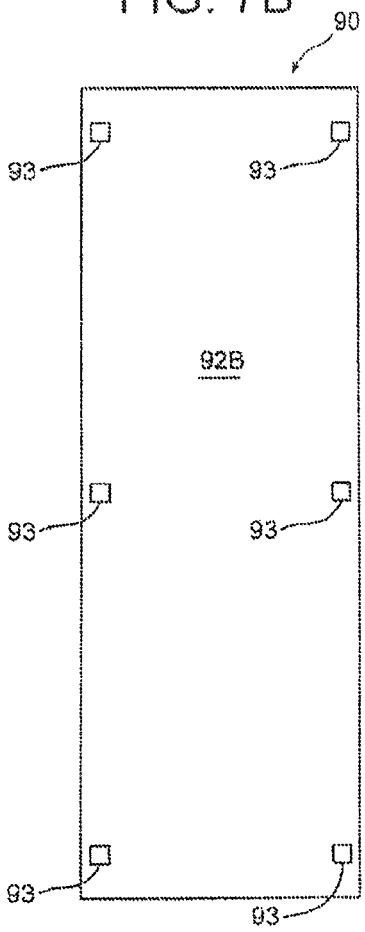
FIG. 7B illustrates a side view of FIG. 7A.
Figure 7C:
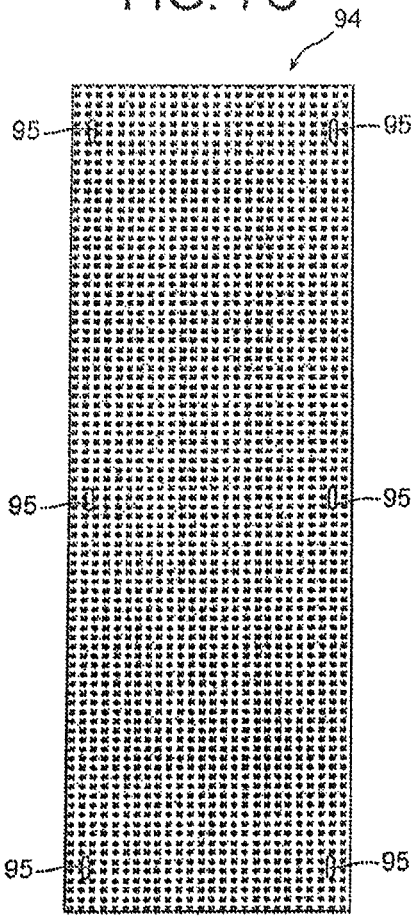
FIG. 7C illustrates a side view of FIG. 7A.
Figure 7D:
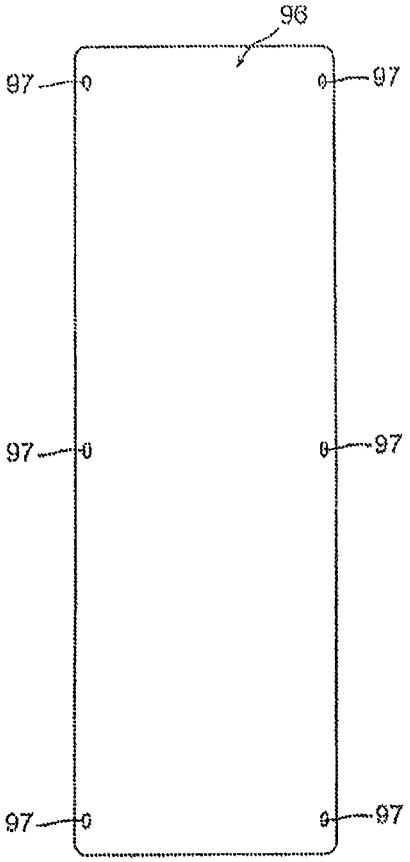
FIG. 7D illustrates a side view of FIG. 7A.
Figure 7E:
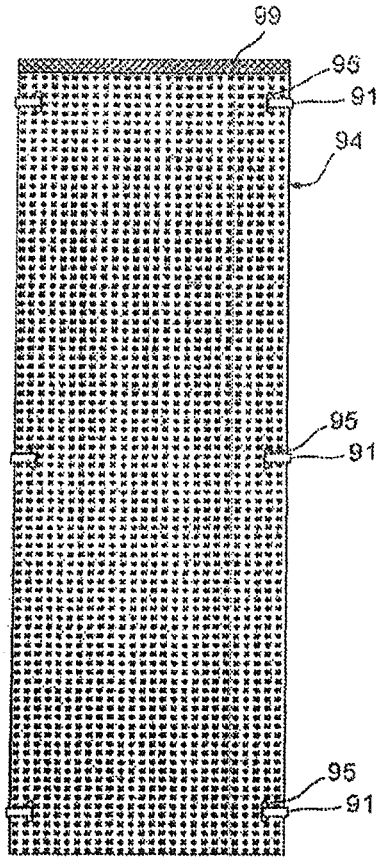
FIG. 7E illustrates a side view of FIG. 7A.
Figure 7F:
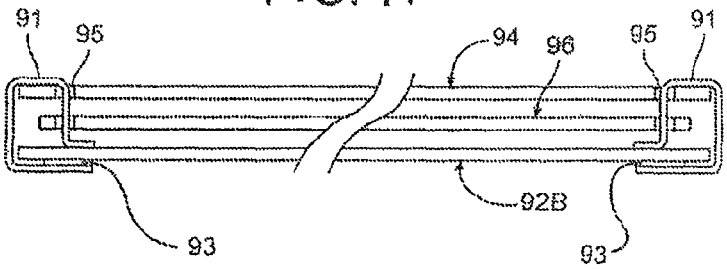
FIG. 7F illustrates a side view of FIG. 7A.

Turning to FIGS. 7A and 7B, another type of fastener is disclosed. These Figures illustrate, but are not limited to, a fastener in the form of a Velcro strap. Shown is base mat 90 having at least one Velcro webbing hook 91 on base mat 92F. On the opposite side of base mat 92 F is at least one Velcro loop 93 disposed on opposite side 92B. Preferably the Velcro webbing hook and matching loop are disposed about the edges of mat 90.

Top mesh 94 is attached to base mat 90 in one embodiment by a fused section 97. Fused section 97 may be the base mat and mesh heat sealed, or otherwise bonded together. Depending on the implementation, section 97 may also be a separate component bonded to the mesh and/or mat. Top mesh 94 has a surface that defines at least one eyelet or hole 95. Preferably the one or more eyelets are disposed around the edges of the mesh. The eyelets may be shaped in the form of an oval, circle, square, polygon, or the like.

Towel 96 also has a surface that defines at least one hole 97. Similar to eyelet or hole 95, hole 97 may be any shape and preferably disposed about the edges of towel 96.

FIG. 7B illustrates the typical use of the mat system in this embodiment. The top mesh 94 and base mat 90 are connected at the respective top edges, and capable of receiving the towel 96 therebetween. Webbing 91 is placed through hole 97 of the towel and hole 95 of the mesh. The webbing Velcro hook 91 goes around the edge of the mesh, towel, and mat assembly to the back side of mat 90 to attach to Velcro loop 93 disposed about surface 92B. Other fasteners may be used, and are not so limited to the examples given herewith, such as zippers, grommets, snap-fits, and the like depending on the implementation.

A benefit of the inventive mats system is that the towel can be removed and changed when desired. A change of towel would be implemented, for example, due to sufficient use of the towel or if a different towel is desired for placement in the mat system. A different towel would be used, for example, if a different logo was desired. Alternatively, a different towel would be used if a different colored towel was desired by the user.

Furthermore, as illustrated in FIG. 1, the yoga mat system can manipulated into a rolled configuration 86. As indicated, above, the material in the base mat is designed so that the mat can only roll in one direction. When rolled, the logo on the bottom of the base mat is visible. The elastic straps are used to keep the mat in the rolled configuration for easy toting and storage.

Figure 8:
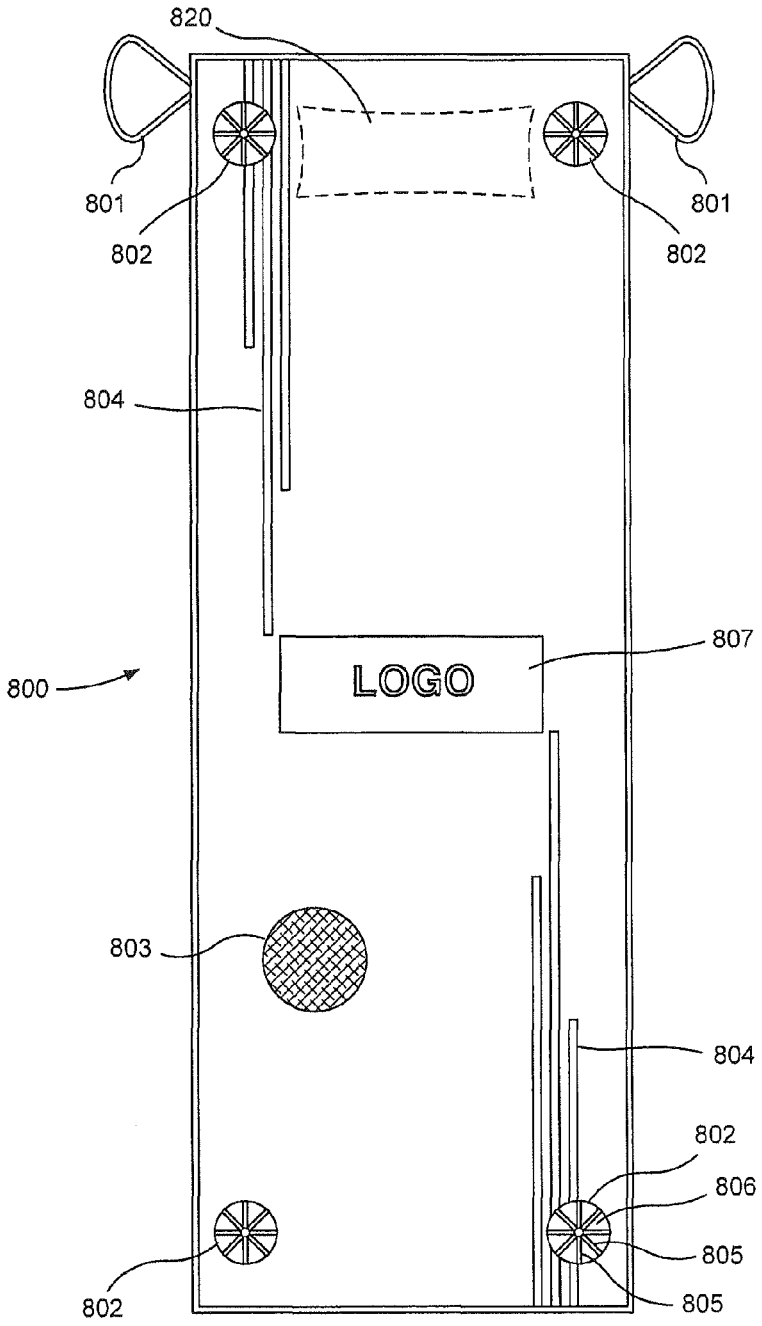
FIG. 8 illustrates a top view of another embodiment of the inventive yoga mat system.

Adverting to FIG. 8, shown is another embodiment of the yoga mat system 800. The mat 800 may have a textured surface 803. Depending on the embodiment, surface 803 may have a taiga like pattern. External ribs 804 may run the length of the yoga mat. Ribs 804 may be disposed on opposite ends of the mat 800. The ribs are for decorative purposes however may add additional security and bonding to a towel placed on the mat 800. Sockets 802 are disposed at the edges of mat 80. The sockets 802, may be of circular form and consist of flexible teeth 805. The teeth form a circle that define a hole 806 for placement of a towel therethrough. The sockets provide security for the towel during yoga exercise. Bands 801 are disposed at the ends of the mat 800. The bands are preferably elastic and may be used for exercise and holding the mat when rolled. A logo 807 may be located on the mat as well. An optional head rest 820 may be attached to the mat 800. Depending on the embodiment the head rest may be removable from the mat by means know to those skilled in the art such as Velcro® (loop and hook fasteners), zippers or the like.

Figure 9:
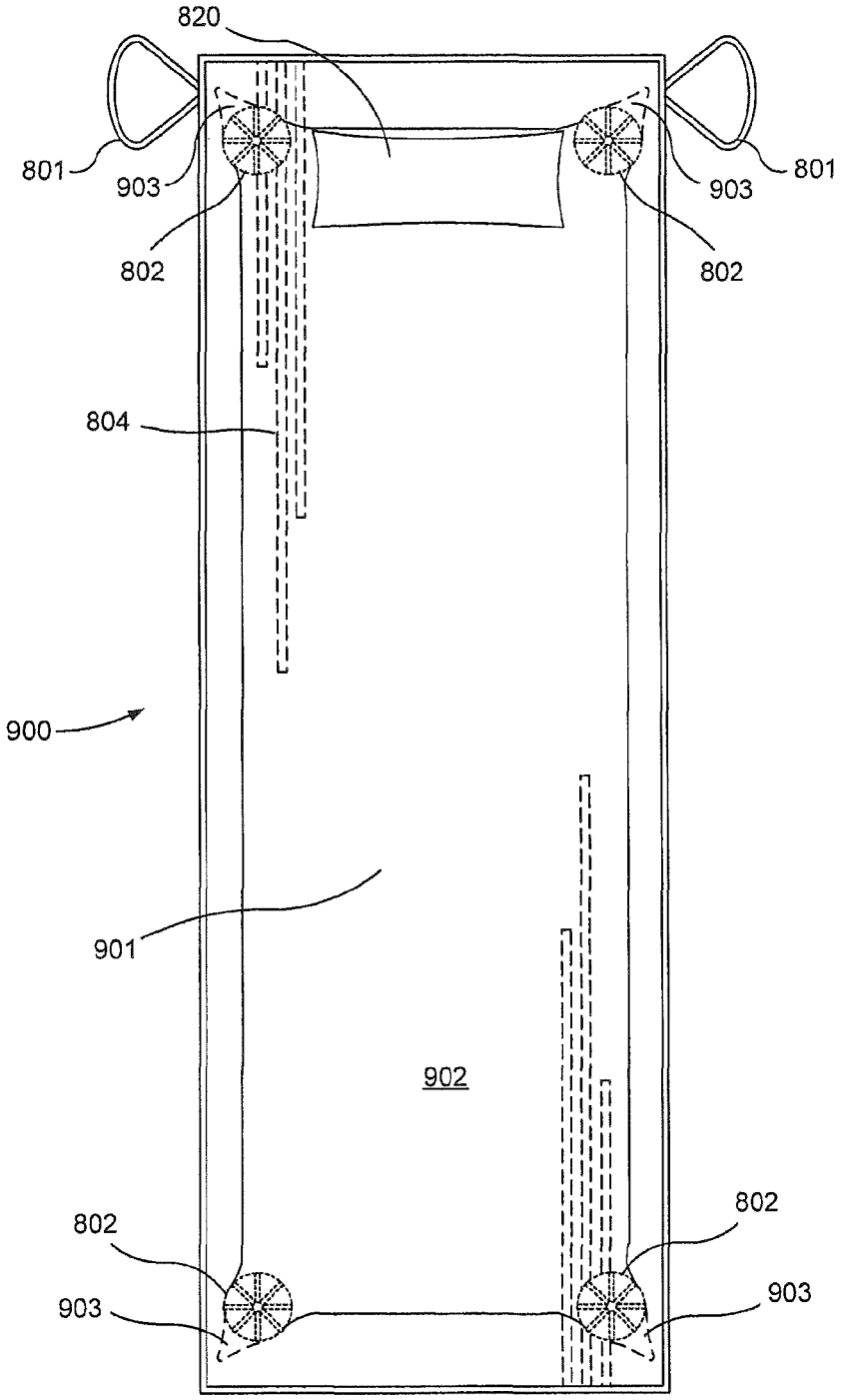
FIG. 9 illustrates the yoga mat system of FIG. 8 with a skidless towel.

FIG. 9 illustrates a removable towel secured to the mat. Shown is mat assembly 900 having a skidless towel 901. Towel 901 has a surface 902 that contains a traction resistant material. The traction resistance material may be at least one of a pattern of dimples, holes, knobs, gussets, beads, mesh, adhesive, dots, ribs, contours, valleys, grooves, and any combination thereof. A removable head rest 820 may be disposed on towel 901 depending on the embodiment. The head rest may be removable as previously described. Edge 903 of towel 901 are placed through hole 806 of socket 802. Teeth 805 hold the towel in place. The traction resistant material offers no security for the towel to be held in place by the mat. The traction resistant material is for allowing a user not to slip off the towel during exercise. Ribs 804 may provide additional security for the towel 901.

Figure 10A:
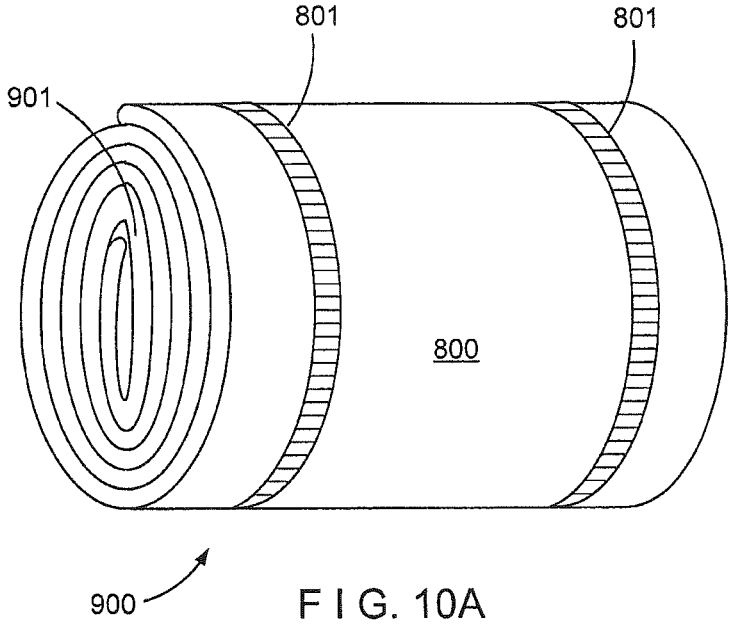
FIG. 10A illustrates the yoga mat system of FIG. 8 in a rolled position.
Figure 10B:
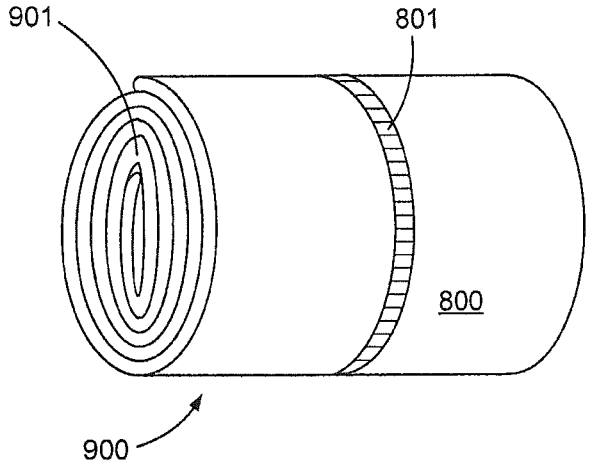
FIG. 10B illustrates the yoga mat system of FIG. 8 in a rolled position.

FIGS. 10A and 10B illustrate the mat 800 in the rolled unused position. Depending on the embodiment the mat may have one strap 801 or a plurality of straps 801. The straps may be used to secure the mate and also used for tension resistance exercise if desired. Again, the benefit of the mat is to remove the towel so it can be machine washed. The traction material will not be diminished by any washing cycle. This towel allows the user to reuse the same towel after each exercise session without washing the mat itself, thereby extending the life of the mat after each exercise.

All dimensions and shapes discussed hereinabove, as well as placement of the components, including the specific locations of the snaps, are for illustration only. Modification in whole or part to any of the components will not change the scope or nature of the inventive yoga mat. Further, the flexible base may be made from a material such as at least one of flexible polyvinyl chloride; polypropylene; polyethylene; thermoplastic elastomer (TPE); polyethylene rubber (PER); latex, natural rubber; jute; cotton; wool; thermoplastic rubber; styrene-butadiene copolymer; or any combination thereof. Alternative materials may be used.

The present invention may be embodied in other specific forms without departing from its spirit or essential characteristics. The described embodiments are to be considered in all respects only as illustrative and not as restrictive.

What is claimed is:

1. An exercise mat assembly, comprising:

a flexible base defining a plurality of sockets;

each socket having a plurality of teeth members that define a hole;

a skidless removable towel attached to said base, said towel having ends and a surface;

the surface of the towel having a traction material disposed opposite the base and not in contact with the base;

the towel removably attached to the base through insertion of all the ends of the towel through the plurality of sockets; and a plurality of raised rib areas disposed on said flexible base, said raised rib areas located on opposite ends of said flexible base for providing security to the towel with the plurality of sockets.

2. The mat assembly as in claim 1 wherein said mat further has an elastic band attached to one end of the mat.

3. The mat assembly as in claim 1 wherein said traction material is traction resistance material is at least one of a pattern of dimples, fabric defining holes, knobs, gussets, beads, mesh, adhesive, dots, ribs, contours, valleys, grooves, and any combination thereof.

4. The mat as assembly in claim 1 wherein said removable towel is machine washable without removal of the traction material.

5. The mat assembly in claim 1 further including a head rest.

6. The mat assembly in claim 1 further including a strap is attached to the towel.

7. The mat assembly in claim 1 wherein said teeth members are shaped as triangles.

8. The mat assembly in claim 7 wherein said triangles form a circle.

9. An exercise mat assembly, comprising:

a flexible base having an attachment means;

a removable towel attached to said base through said attachment means; and the removable towel has skidless material disposed opposite the base and not in contact with the base;

wherein a user's feet is in contact with said skidless material; and a plurality of raised rib areas disposed on said flexible base, said raised rib areas located on opposite ends of said flexible base for providing security to the towel with the attachment means.

10. The mat assembly in claim 9 further including an elastic band.

11. The mat assembly in claim 10 further including a head rest.

12. The mat assembly in claim 11, wherein the head rest is on the flexible base.

13. The mat assembly in claim 11, wherein the headrest is on the towel.

14. The mat assembly in claim 11 wherein said head rest is removable.

15. The mat assembly in claim 9 wherein said towel and said base are connected by at least one socket having flexible teeth members.

16. The mat assembly in claim 9 wherein said flexible base is made from the material of at least one of flexible polyvinyl chloride; polypropylene; polyethylene; thermoplastic elastomer (TPE); polyethylene rubber (PER); latex, natural rubber; jute; cotton; wool; thermoplastic rubber; styrene-butadiene copolymer; or any combination thereof.

17. An exercise mat assembly, comprising:

a flexible base having at least one socket having flexible teeth and an attachable and removable towel disposed between said flexible teeth to hold said towel;

the removable towel having a skidless material disposed opposite the base and not in contact with the base; and a plurality of raised rib areas disposed on said flexible base, said raised rib areas located on opposite ends of said flexible base for providing security to the towel with the at least one socket.

18. The mat assembly in claim 17 further including a tension strap attached to an end of said base for exercise and securely holding the mat assembly when rolled.

* * * * *